US006834449B2

(12) United States Patent
Leslie et al.

(10) Patent No.: US 6,834,449 B2
(45) Date of Patent: Dec. 28, 2004

(54) EXCAVATOR BUCKET

(75) Inventors: Bruce Alexander Leslie, Redbank (AU); Graham Ian Lumley, Calamvale (AU); Thomas Anthony Meyers, 39 Annie Wood Avenue, Mackay, Queensland, 4740 (AU)

(73) Assignee: Thomas Anthony Meyers, Mackay (AU)

( * ) Notice: Subject to any disclaimer, the term of this patent is extended or adjusted under 35 U.S.C. 154(b) by 1 day.

(21) Appl. No.: 10/261,878

(22) Filed: Oct. 1, 2002

(65) Prior Publication Data

US 2003/0066212 A1 Apr. 10, 2003

(30) Foreign Application Priority Data

Oct. 2, 2001 (AU) ..... PR8033

(51) Int. Cl.[7] ..... E02F 3/60
(52) U.S. Cl. ..... 37/398; 414/726
(58) Field of Search ..... 37/399, 400, 401, 37/445, 398, 444; 414/718, 719, 722, 725–728

(56) References Cited

U.S. PATENT DOCUMENTS

| | | | | | |
|---|---|---|---|---|---|
| 392,982 | A | | 11/1888 | Beck | |
| 759,971 | A | * | 5/1904 | Hanaford | 271/249 |
| 1,573,128 | A | * | 3/1926 | Baker | 604/26 |
| 1,638,099 | A | * | 8/1927 | Rorabeck | 37/465 |
| 1,822,423 | A | * | 9/1931 | Robin et al. | 75/240 |
| 1,879,447 | A | * | 9/1932 | Page | 37/398 |
| 1,938,163 | A | * | 12/1933 | Yaun | 37/398 |
| 2,334,460 | A | | 11/1943 | Weimer | |
| 2,895,239 | A | * | 7/1959 | Larsen | 37/398 |
| 3,247,606 | A | | 4/1966 | Page | |
| 3,352,038 | A | * | 11/1967 | Kalve | 37/398 |
| 3,597,865 | A | | 8/1971 | Rumfelt | |
| 4,791,738 | A | | 12/1988 | Briscoe | |
| 4,944,102 | A | | 7/1990 | Behlendorf et al. | |
| 5,140,761 | A | | 8/1992 | Coffman et al. | |
| 5,307,571 | A | | 5/1994 | Behlendorf et al. | |
| 5,343,641 | A | | 9/1994 | Gregory | |
| 5,400,530 | A | | 3/1995 | Schmidt | |
| 5,575,092 | A | | 11/1996 | Smit | |
| D392,983 | S | | 3/1998 | Watts | |
| 5,752,334 | A | * | 5/1998 | Immel | 37/396 |
| 5,832,638 | A | | 11/1998 | Watts | |
| 6,209,234 | B1 | * | 4/2001 | Meyers | 37/398 |
| 6,237,260 | B1 | * | 5/2001 | Gooch | 37/398 |
| 6,272,775 | B1 | * | 8/2001 | Schmidt et al. | 37/399 |
| 6,484,423 | B1 | * | 11/2002 | Murray | 37/396 |

FOREIGN PATENT DOCUMENTS

| | | | | |
|---|---|---|---|---|
| AU | 9173955 A | * | 10/1991 | E02F/3/58 |
| AU | 200138977 A | * | 11/2001 | B60P/3/06 |

* cited by examiner

*Primary Examiner*—Robert E Pezzuto
(74) *Attorney, Agent, or Firm*—Workman Nydegger

(57) ABSTRACT

A dragline bucket comprises a floor, opposed side walls and a rear wall; a front lip on the floor having adaptors to releasably secure cutting teeth thereto; opposed cheek plates adjacent respective front portions of the side walls; and, hoist rope attachment members located intermediate front and rear portions of the bucket. The bucket has a wide, relatively shallow configuration wherein the rear wall has a height greater than the adjacent side wall portions and respective junctions between the floor and side walls are formed with an arcuate inner surface and there is an arcuate taper between the floor and the top of the rear wall.

22 Claims, 4 Drawing Sheets

EXCAVATOR BUCKET

FIELD OF THE INVENTION

This invention is concerned with improvements in excavation buckets for earthworking apparatus.

This invention is concerned particularly although not exclusively with a light-weight high capacity bucket for a dragline excavation.

BACKGROUND OF THE INVENTION

Dragline excavation apparatus represents a very large capital expenditure of the order of hundreds of millions of dollars and operating overheads can cost in excess of US $3000 per hour. Accordingly it is necessary to maximise the efficiency of such draglines as they operate 24 hours a day, 7 days a week. Any reduction in operational efficiency can represent substantial annual productivity losses when it is considered that a typical excavation payload is about 80 tonnes of earth.

Generally speaking, most dragline excavators are a compromise between competing factors. While a longer boom length may improve operational efficiency by providing an increased dump radius, the load capacity of the boom is reduced proportionately. Similarly, bucket/rigging combinations of reduced mass may permit increased payloads but this is usually at the expense of bucket control and increased maintenance and downtime costs.

A number of characteristics are employed to determine operational efficiencies of dragline buckets. These include:

DRAG ENERGY: A measure of the energy required to fill a bucket of a given capacity. Factors affecting drag energy include the extent of frictional engagement between internal and external bucket surfaces and earth masses within and without the bucket respectively, tooth/cutting edge configuration and dead weight of the bucket/rigging combination, TOTAL SUM LOAD (TSL): The sum of the masses of the bucket, the rigging and the payload.

Over the years there have been many modifications to excavator bucket designs and rigging configurations to achieve at the same TSL a greater payload as a proportion of TSL and/or to reduce the cycle time of the bucket.

U.S. Pat. No. 2,334,460 describes an archless bucket with a substantial lip casting which extends up to the top of the side walls to support pivotal drag chain couplings thereon. The side walls and rear wall, all of substantially the same height, are generally planar and diverge outwardly at their upper edges. This configuration is considered to have reduced volumetric capacity and is not suited to heavy service life due to its inefficient lip design and flimsy construction necessitating internally mounted hoist rope mountings which are subject to increased wear.

U.S. Pat. No. 3,247,606 describes a high backed bucket which may be constructed with or without a front arch. This bucket configuration is considered to be inefficient in terms of the drag energy required to fill the bucket and material losses out of the front of the bucket during the initial hoist operation. An exaggerated rear tilt carry angle is required to reduce spillage but this may lead to instability in the bucket with difficult or premature dumping.

U.S. Pat. No. 5,400,530 describes an archless bucket with a low tapered rear wall for rearward dumping. The hoist ropes are mounted on slidable trunnions located within the bucket and secured to a very substantial lip casting with integral cheek plates to which the drag ropes devises and the slidable hoist rope trunnions are secured. This bucket is not considered to be sufficiently durable for sustained heavy duty operation nor is it considered to be sufficiently stable for optimised operations.

Another high backed archless bucket is descried in U.S. Pat. No. 3,247,607. The combination of bucket and the rigging system employed to achieve the desired carry angle are considered to add substantially to the "dead" portion of an excavator payload.

U.S. Pat. Nos. 4,791,738, 5,575,092, 3,597,865, 5,343,641, 5,307,571 and 5,140,761 are illustrative of contemporary bucket/rigging systems which, while durable, are very heavy and limit operational efficiencies of a dragline excavator.

U.S. Pat. No. 4,944,102 addresses certain of the problems with prior art excavator bucket designs and claims to offer improvements thereover. This patent particularly addresses the problem with prior art buckets having a back wall approximately the same height as the side walls wherein excess time and energy is spent endeavouring to fill the bucket completely. The problem of excessive bucket and rigging mass is said to be overcome by reducing the height and amount of material in the back wall and locating the hoist rope trunnions inwardly of the bucket side walls thereby eliminating the need for a spreader bar. On balance, It is considered that this bucket/rigging assembly would offer only marginal, if any, improvement in operational efficiency compared with contemporary prior art systems.

A low draft, high yield bucket system is described and illustrated in U.S. Pat. No. 5,832,638 and U.S. Design Pat. Des No. 392,983. These documents show an upwardly sloping lip leading to a planar floor and outwardly divergent side walls which taper rearwardly and which have an upright portion extending longitudinally thereof. A rear wall has a lower outwardly divergent portion and an upper inwardly convergent portion. Lip end cutters extend forwardly and upwardly from the front cutting lip and diverge outwardly at the same angle as the outwardly divergent portion of the side walls. This bucket is claimed to be about half the weight of a conventional bucket as less wear plates are required to address the problem that the sides, backs and bottoms of prior art buckets did not fit the cleave planes in the earth mass behind the front lip. With prior art buckets it is Indicated that interior wear plates are required as the earth is extruded with great force into a conventional bucket having a generally D shaped cross section with straight sides.

In a conventional bucket it is claimed that there is little or no increase in cross section within the bucket to allow lateral swell of excavated material which is squeezed and forced upward at a great loss of drag energy.

In use, The bucket of U.S. Pat. No. 5,832,638 is said to provide an optimised loading distance of approximately 3 bucket lengths compared with 1.5 to 2 lengths of a conventional bucket. This bucket is also claimed to tilt, under the influence of a tilt back system to a precise preset tilt back angle relative to the stops in the dump line. In so doing the bucket spills excess earth over the back and sides and leaves the bucket with a relatively predictable weight to match the operating weight of the dragline. This spillage is considered to largely negate any of the claimed benefits of this bucket and rigging assembly.

It is an aim of the present invention to provide an improved excavator bucket which overcomes or alleviates at least some of the disadvantages associated with prior art excavator buckets.

SUMMARY OF THE INVENTION

According to one aspect of the invention there is provided a dragline bucket comprising:

a floor, opposed side walls and a rear wall;

a lip extending transversely of a front portion of said floor, said lip being adapted to receivably locate a plurality of spaced cutting teeth;

opposed cheek plates adjacent respective front portions of said side walls, said cheek plates each being adapted for attachment of rigging members; and, hoist rope attachment members located intermediate front and rear portions of said bucket, said bucket characterised in that said rear wall has a height greater than adjacent side wall portions and respective junctions between said floor and said side walls each are formed with an arcuate inner surface.

Suitably said rear wall tapers upwardly from said floor.

If required said rear wall may taper upwardly from said floor in an arcuate manner.

The rear wall may include a flange member extending about an upper edge thereof.

Suitably the flange member extends from respective upper edges of said side walls about said rear wall.

Preferably said flange member extends inwardly of at least said rear wall.

If required, front portions of respective side walls may be of a height greater than respective side wall portions adjacent said rear wall.

The lip may include spaced tooth adaptors formed integrally therewith.

Alternatively the spaced tooth adaptors may be removably secured to said lip.

Suitably said tooth adaptors comprise convergently tapered upper and lower faces adapted to engage in respective tapered sockets of teeth removably secured thereto.

If required said teeth may be secured to said adaptors by screw threaded members threadably locatable in said tooth.

Suitably respective junctions between said cheek plates and adjacent floor and/or front lip portions are formed with an arcuate inner surface.

The cheek plates may be formed separately from or integral with said front lip.

Suitably, leading edge portions of said cheek plates are inclined forwardly from respective lower regions thereof.

Preferably said cheek plates are adapted to receivably locate removable wear plates and/or cutting edges.

If required, the arcuate inner surfaces formed at the respective junctions of side walls and the floor of said bucket are formed as shaped junction members adapted for attachment to respective side walls and the floor.

The junction members may extend to form respective junctions of said side walls and said rear wall.

Suitably said junction members each comprise one or more castings.

If required said hoist rope attachment members may be attached to respective junction members.

Preferably said hoist rope attachment members are formed integrally with respective junction members.

Suitably said side walls and said floor in plan view taper rearwardly towards said rear wall.

BRIEF DESCRIPTION OF THE DRAWINGS

In order that the invention may be more fully understood and put into practical effect, reference will now be made to a preferred embodiment described in the accompanying drawings in which.

For the sake of simplicity, like reference numerals are employed for like features in the drawings.

DETAILED DESCRIPTION OF THE DRAWINGS

Figure 1:
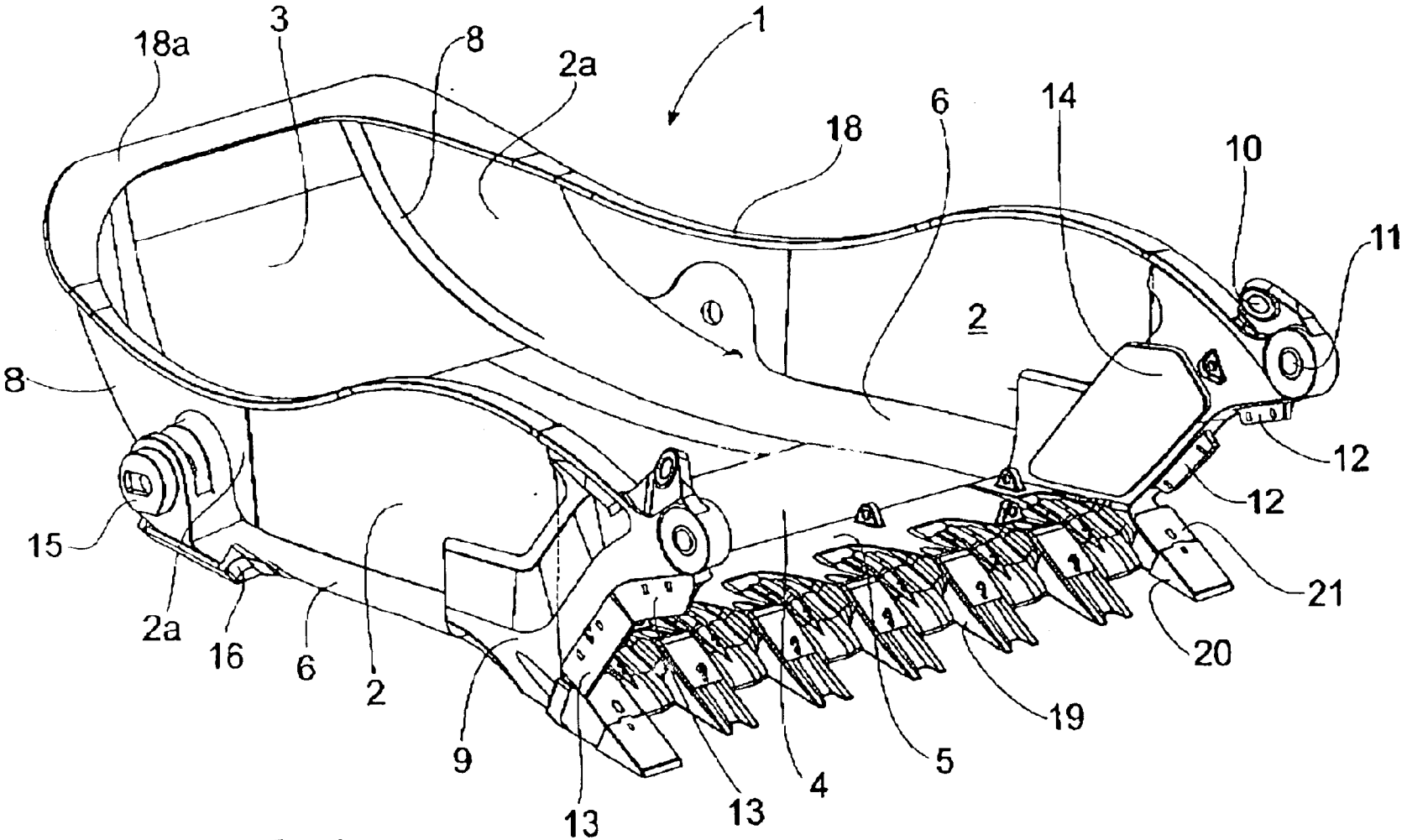
FIG. 1 shows a perspective view of a bucket according to the invention.

In FIG. 1 bucket 1 includes side walls 2, a rear wall 3, a floor 4 and a front lip 5.

Figure 2:
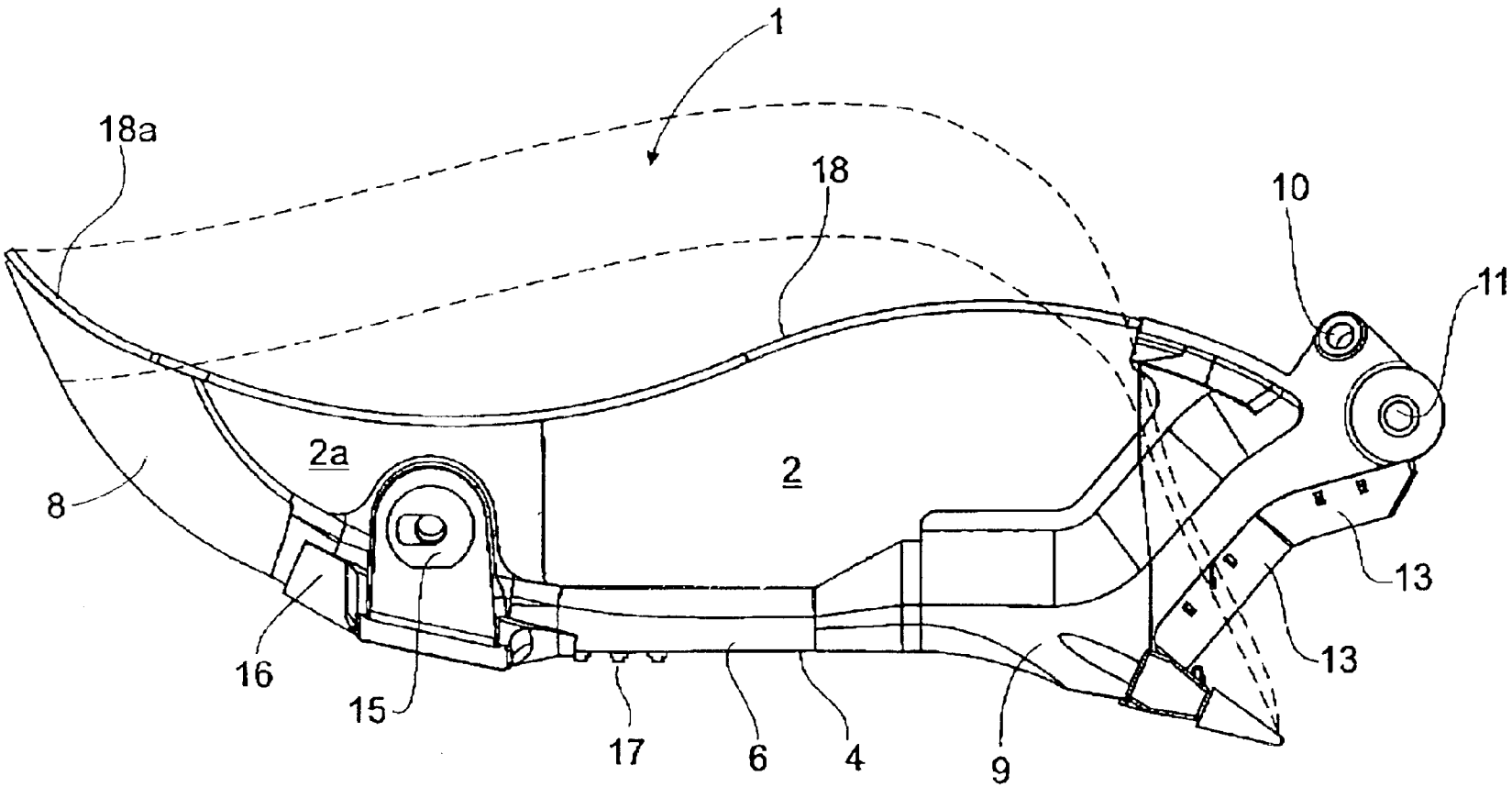
FIG. 2 shows a side elevational view of the bucket of FIG. 1.

As shown more clearly in FIG. 2, bucket 1 has a generally planar floor 4 behind lip 5, floor 4 sweeping upwardly in an arcuate path to form a rear wall 3.

Side walls 2 and floor 4 are formed from steel plate and are secured together by cast steel junction members 6 which form a smooth radiussed junction between the side walls 2 and floor plate 4. Castings 6 and respective side walls 2 and floor 4 are secured together by welding. Side walls 2 may be formed as single members or, to accommodate the compound curvature of the bucket shape, rear side wall portions 2*a* may be formed as separate elements and welded to side wall portions 2 as shown.

To accommodate the curvature in the rear portion of floor 4, the rear portion 4*a* may be formed from a separate steel plate and welded along junction 7 if required. Alternatively the floor 4 may be formed as a single element which is contoured by a rolling or bending operation.

Similarly, rear wall 3 may be formed as a separate element welded to floor 4/4*a* at junction 8 or the entire floor and rear wall portion may be formed as a single element, again contoured by a rolling or being operation.

In a similar fashion, rear wall 3 is secured to the rear portion of side walls 2 by cast steel junction members 8 which sweep upwardly and rearwardly to provide a large radiussed juncture between the rear wall 3 and side walls 2 with smooth radiussed inner and outer surfaces. Junction members 6/8 may be formed as separate castings or integral members.

At the front edges of side walls 2 there are secured cheek plates 9 having dump eyes 10 to receive mounting clevises of dump rope attachments. Drag eyes 11 are provided to receive devises of drag rope attachments. Cheek plates 9 may be formed as separate castings or they may be formed integrally with front lip 5.

The forwardly inclined edges of cheek plates 9 are formed with mounting members 12 to receive removable side cutters 13. In addition cheek plates 9 include on their inner faces removable wear plates 14.

Trunnion mounts 15 are secured to side walls 2, junction members 6 and portion of floor 2 by shaped castings 16 which are welded to or formed integrally with junction members 6 and/or 8. These trunnion mounts are of a conventional type well known to a person skilled in the art and, as such, do not form part of the invention. If required, wear plates 17 may be secured to the outer surface of floor 4 as shown in a "heel region" susceptible to wear in use.

Located around the upper edges of side walls 2 and rear wall 3 is a transversely extending stiffening flange 18. The rear portion 18*a* of flange 18 is wider than that of the side flange portions 18 and extends inwardly of the side and rear wall portions 2*a*, 3 to provide additional stiffening and load retention qualities.

Cutting teeth 19 are removably attached either directly to mounting projections formed on lip 5 or on intermediate adaptors, also removably secured to lip 5. The outside cutting teeth 20 are of a conventional type and are mounted on conventional intermediate adaptors 21 secured to lip 5. Teeth 20 provide an improved cutting action in earth excavation.

In use, the bucket as shown in the drawings typically will be used with a conventional rigging system comprising a spreader bar at least for the hoist ropes and an equaliser assembly with pivoted couplings and a dump rope sheave providing a coupling of a dump rope between a drag rope and dump eyes 10 as generally described in U.S. Pat. No. 4,791,738. Alternatively, a rigging assembly of the type described in U.S. Pat. No. 6,209,234 is preferably employed to reduce the overall rigging mass and otherwise contribute to increased bucket payloads.

TABLE 1 is a comparison between a conventional dragline bucket such as a CQMS "Earth Eater" (Trade Mark), ESCO or P & H 37 tonne bucket and a similar bucket according to the present invention.

TABLE 1

| PROPERTY | PRIOR ART | INVENTION |
|---|---|---|
| Bucket Mass | 37 tonne | 27 tonne |
| Payload | 95 tonne | 105 tonne |
| Lip Width | 4.2 meters | 5.5 meters |
| Side Well Height | 2.5 meters | 1.2–1.5 meters |
| Bucket Fill Time | 15 seconds. | 12 seconds |

Figure 4:
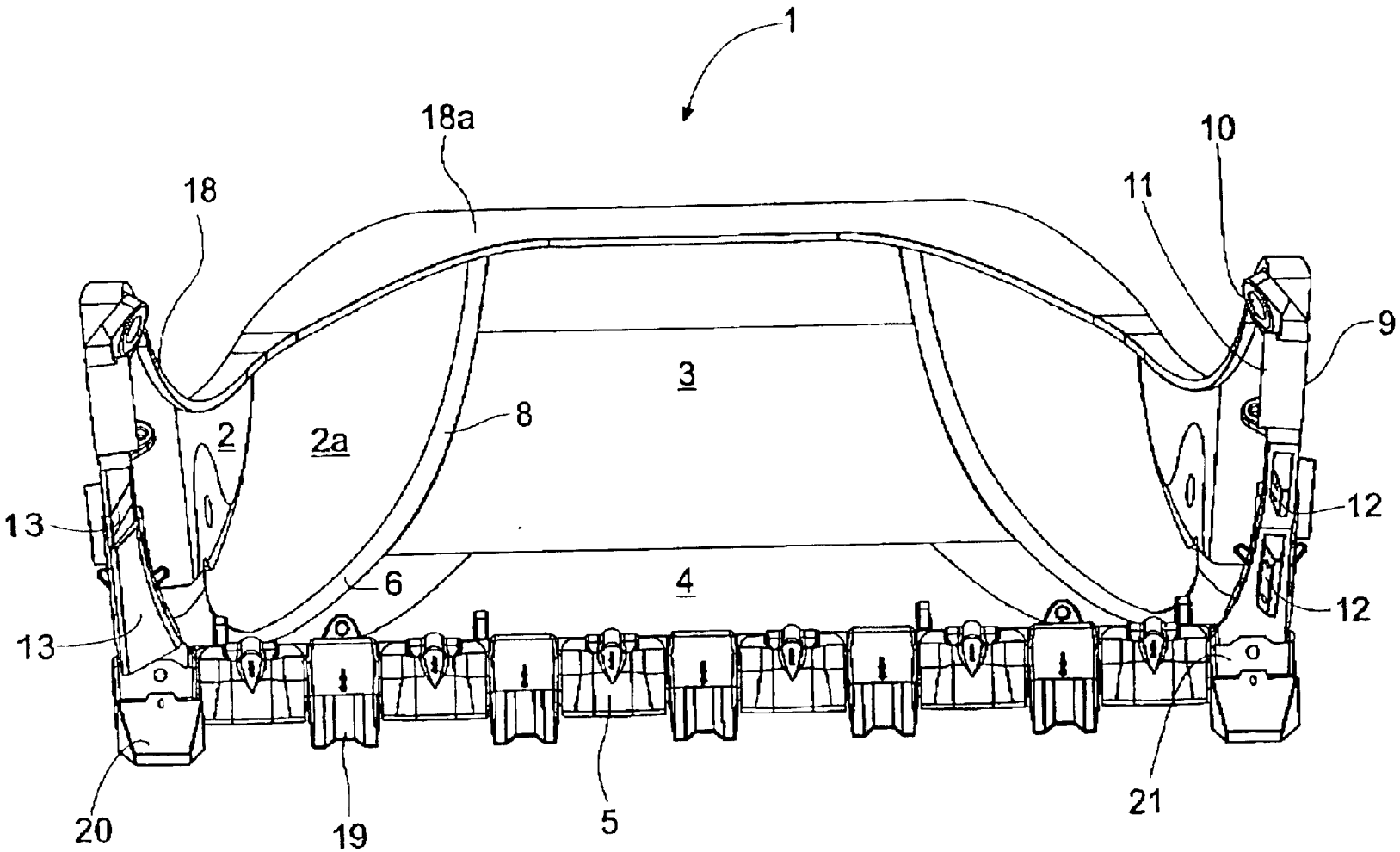
FIG. 4 shows a front elevational view of the bucket of FIG. 1.

As can be seen from FIG. 4 the side wall height:lip width ratio of the bucket illustrated in the drawings is about 1:4, This side wall height:lip width ratio compares to prior art buckets wherein the ratio is typically from 1:1.5 to 1:2 for general heavy duty dredging buckets.

As also can be seen from FIG. 2 the floor contact length, as a proportion of overall bucket length measuring from the tips of the cutting teeth is about 60% compared with about 75% for the bucket of U.S. Pat. No. 5,832,638 or up to about 85% for a contemporary prior art bucket of the type shown in U.S. Pat. No. 4,791,738.

The benefits obtainable by the present invention are considered to flow from the low profile configuration where the lip width effective side wall height are in the ratio 3:1 to 4:1 as the functional engagement between the inner and outer side wall surfaces and the earth being excavated are much less per tonne of earth being excavated and the area of contact between the bucket and the earth is proportionally less than prior art buckets, These features, coupled with the substantially reduced bucket mass arising from reduced materials content from the low side walls and the omission of the arch usually required to stiffen high side walls gives rise to a bucket which is just as durable, if not more durable than conventional buckets weighing up to 40 tonnes.

Figure 3:
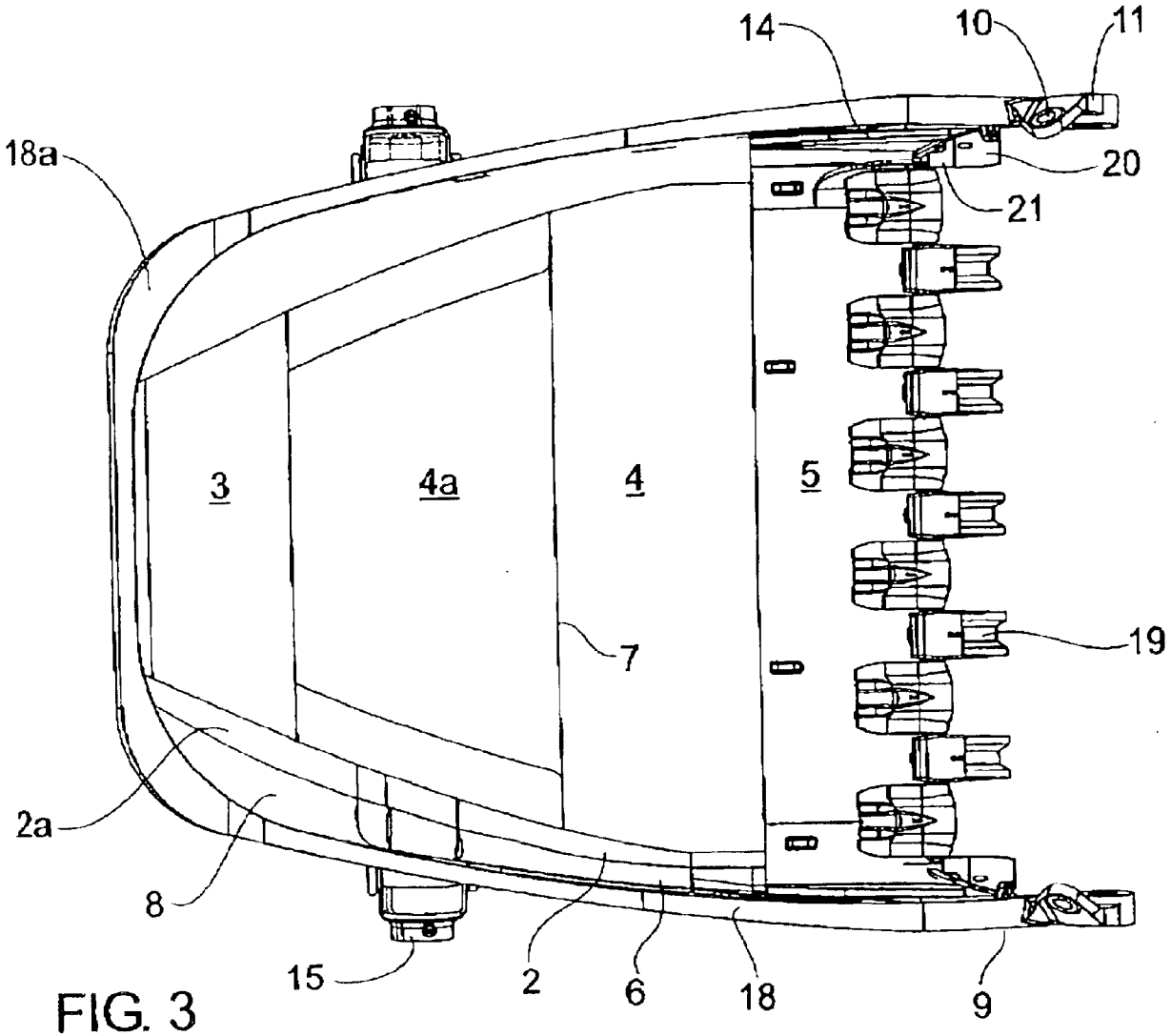
FIG. 3 shows a plan view of the bucket of FIG. 1.

As shown in FIG. 3, the side walls of the bucket are substantially parallel in the region of the cheek plates and thereafter both the side walls and the floor taper arcuately in a rearward direction. In use, the bucket typically will cut a slab of earth about 1.2 metres deep which moves easily into the bucket as the high width to depth ration of the bucket mouth opening minimises the hydrostatic pressure in the earth mass, in turn reducing the frictional pressure against the side walls.

As the slab moves to about half way back in the bucket the gradually tapering side walls and the upwardly tapering floor apply a progressive restriction to the earth slab until the restrictive pressures effectively arrest the slab at the back wall. At this juncture a further slab is forced up and over the initial slab to form a heap having its crown approximately adjacent the highest points of the side walls.

The raised rear wall supports a greater volume of earth for a given bucket carry angle than otherwise would be possible with a similar bucket having a rear wall of the same height or lower than the side walls. This feature is shown in phantom in FIG. 2.

Another advantage of the tapering side walls is that the trunnion mounts 15 are largely in the shadow of cheek plates 9 during an excavation process. This is expected to contribute to reduced wear in this area.

The durability and increased load capacity of the bucket according to the invention is attributed, at least in part, to the large radiussed junctions between the side walls 2 and floor 4 of the bucket and the curved side walls and floor which cooperate to disperse internal hydrostatic pressures substantially evenly in a manner similar to a spherical or partly spherical pressure vessel.

Generally speaking, the bucket according to the present invention has a wide, relatively shallow configuration when compared with prior art buckets and has a rear wall higher than adjacent side wall portions with an arcuate taper between the floor and the top of the rear wall.

All of the various features of the bucket according to the invention are considered to contribute to a greater or lesser degree to a substantially reduced drag energy requirement for the same or greater payload than a conventional dragline bucket. Tests conducted to date on a prototype have shown that for a payload increase of about 10%, drag energy can be reduced to about 70% of a conventional bucket while at the same time reducing bucket fill time by 20%.

Overall, the vastly improved bucket efficiency, when compared with prior art buckets of a similar capacity, promises very significant productivity increases with an equally significant reduction in overheads.

It readily will be apparent to a person skilled in the art that many modifications or improvements may be made to the invention without departing from the spirit and scope thereof.

Throughout this specification and claims which follow, unless the context requires otherwise, the word "comprise", and variations such as "comprises" or "comprising", will be understood to imply the inclusion of a stated integer or group of integers or steps but not the exclusion of any other integer or group of integers.

What is claimed is:

1. A front dumping dragline bucket comprising:

an elongate floor, opposed side walls and a rear wall;

a lip extending transversely of a front portion of said floor, said lip being adapted to receivably locate a plurality of spaced cutting teeth;

opposed cheek plates adjacent respective front portions of said side walls, said cheek plates each being adapted for attachment of rigging members; and, hoist rope attachment members located intermediate front and rear portions of said bucket, wherein said rear wall has a height greater than adjacent side wall portions and respective junctions between said floor and said side walls each are formed with an arcuate inner surface and wherein said rear wall tapers upwardly from said floor in an arcuate manner.

2. A bucket as claimed in claim 1 wherein the rear wall includes a flange member extending about an upper edge thereof.

3. A bucket as claimed in claim 2 wherein the flange member extends from respective upper edges of said side walls about said rear wall.

4. A bucket assembly as claimed in claim 3 wherein said flange member extends inwardly of at least said rear wall.

5. A bucket as claimed in claim 1 wherein front portions of respective side walls are of a height greater than respective side wall portions adjacent said rear wall.

6. A bucket as claimed in claim 1 wherein the lip includes spaced tooth adaptors formed integrally therewith.

7. A bucket as claimed in claim 6 wherein said tooth adaptors comprise convergently tapered upper and lower faces adapted to engage in respective tapered sockets of teeth removably secured thereto.

8. A bucket as claimed in claim 7 wherein said teeth are secured to said adaptors by screw threaded members threadably locatable in said teeth.

9. A bucket as claimed in claim 1 wherein the spaced tooth adaptors are removably secured to said lip.

10. A bucket as claimed in claim 9 wherein said tooth adaptors comprise convergently tapered upper and lower faces adapted to engage in respective tapered sockets of teeth removably secured thereto.

11. A bucket as claimed in claim 10 wherein said teeth are secured to said adaptors by screw-threaded members threadably locatable in said teeth.

12. A bucket as claimed in claim 1 wherein respective junctions between said cheek plates and adjacent floor and/or front lip portions are formed with an arcuate inner surface.

13. A bucket as claimed in claim 12 wherein the cheek plates are formed separately from or integral with said front lip.

14. A bucket as claimed in claim 13 wherein leading edge portions of said cheek plates are inclined forwardly from respective lower regions thereof.

15. A bucket as claimed in claim 1 wherein said cheek plates are adapted to receivably locate removable wear plates and/or cutting edges.

16. A bucket as claimed in claim 12 wherein the arcuate inner surfaces formed at the respective junctions of side walls and the floor of said bucket are formed as shaped junction members adapted for attachment to respective side walls and the floor.

17. A bucket as claimed in claim 16 wherein the junction members extend to form respective junctions of said side walls and said rear wall.

18. A bucket as claimed in claim 16 wherein said junction members each comprise one or more castings.

19. A bucket as claimed in claim 16 wherein said hoist rope attachment members are attached to respective junction members.

20. A bucket as claimed in claim 16 wherein said hoist rope attachment members are formed integrally with respective junction members.

21. A bucket as claimed in claim 1 wherein said side walls and said floor in plan view taper rearwardly towards said rear wall.

22. A bucket as claimed in claim 1 wherein the rear wall is fixed to the floor so that the rear wall cannot move independent of the floor.

* * * * *

UNITED STATES PATENT AND TRADEMARK OFFICE

CERTIFICATE OF CORRECTION

PATENT NO. : 6,834,449 B2 
APPLICATION NO. : 10/261878
DATED : December 28, 2004
INVENTOR(S) : Bruce Alexander Leslie et al.

It is certified that error appears in the above-identified patent and that said Letters Patent is hereby corrected as shown below:

Figure 3

Replace figure 3 with the figure depicted herein below, wherein reference character "7a" has been added.

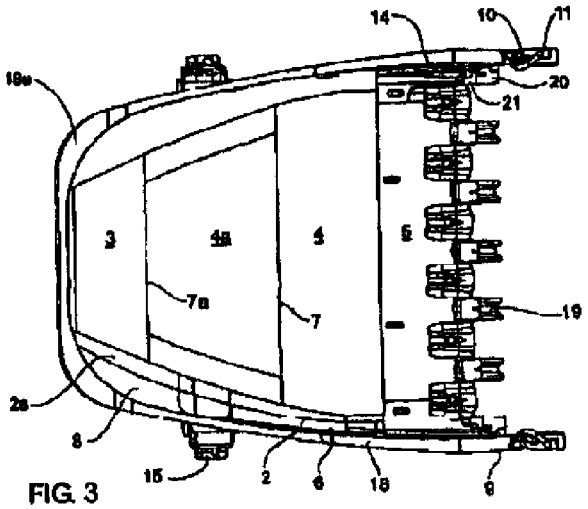

FIG. 3

Column 2

Line 1, change "devises" to --clevises--

Line 27, change "It" to --it--

UNITED STATES PATENT AND TRADEMARK OFFICE

CERTIFICATE OF CORRECTION

PATENT NO. : 6,834,449 B2
APPLICATION NO. : 10/261878
DATED : December 28, 2004
INVENTOR(S) : Bruce Alexander Leslie et al.

It is certified that error appears in the above-identified patent and that said Letters Patent is hereby corrected as shown below:

Column 4
Line 36, change "8" to --7a--
Line 38, change "being" to --bending--
Line 50, change "devises" to --clevises--
Line 58, after "floor" change "2" to --4/4a--

Signed and Sealed this

Eighteenth Day of August, 2009

David J. Kappos

David J. Kappos
*Director of the United States Patent and Trademark Office*